US006252199B1

(12) United States Patent
Toyota et al.

(10) Patent No.: US 6,252,199 B1
(45) Date of Patent: Jun. 26, 2001

(54) HEATING ROLLER FOR FIXING

(75) Inventors: Katsuya Toyota, Kagoshima; Takahiro Maruyama, Shiga; Shinsuke Takenishi, Shiga; Kyoji Uchiyama, Shiga; Shigenobu Nakamura, Kagoshima; Kouihi Hayashi, Shiga, all of (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/538,094

(22) Filed: Mar. 29, 2000

Related U.S. Application Data

(62) Division of application No. 09/032,245, filed on Feb. 27, 1998, now Pat. No. 6,096,995.

(30) Foreign Application Priority Data

May 30, 1997 (JP) ..... 9-142678
Jun. 27, 1997 (JP) ..... 9-172591

(51) Int. Cl.[7] ..... G03G 15/20
(52) U.S. Cl. ..... 219/216; 399/330
(58) Field of Search ..... 219/216, 469; 399/330, 331, 333

(56) References Cited

U.S. PATENT DOCUMENTS 4,874,927 * 10/1989 Shibata et al. ..... 219/469
5,616,263 * 4/1997 Hyllberg ..... 219/469
5,722,025 * 2/1998 Morigami et al. ..... 399/330

FOREIGN PATENT DOCUMENTS 58-2864 * 1/1983 (JP) .
59-172669 * 9/1984 (JP) .
8-155748 * 6/1996 (JP) .

* cited by examiner

*Primary Examiner*—Joseph Pelham
(74) *Attorney, Agent, or Firm*—Hogan & Hartson, LLP

(57) ABSTRACT

In a heating roller for fixing which is constituted such that a heating resistor 3 is provided onto an inner circumferential surface 1*a* of a cylinder 1 with an insulating layer 2 lying therebetween and a cleavage layer 6 is provided onto an outer circumferential surface, electrical insulating properties of the insulating layer 2 are maintained satisfactorily for a long time.

A maximum height (Rmax) of surface roughness of the inner circumferential surface 1*a* of the cylinder 1 is in the range of 0.8 of 50 $\mu$m.

A resistance value in the heating roller for fixing is partially adjusted easily.

In a heating roller for fixing having a heating resistor 103 on a surface of a cylinder 101 with an insulating layer 102 lying therebetween, the heating resistor 103 is divided into a plurality of zones in an axial direction of the cylinder 101, and slots for adjusting resistance are formed in each zone.

In a heating roller for fixing, a generated heat is prevented from dispersing, uniform heating can be performed, heat loss is reduced, and thus power is tried to be saved.

A heating resistor 203 is provided to an inner surface of a cylinder 201, and an electrode member 205 connected to the heating resistor 203 is provided to both ends of the cylinder 201 on the inner side, and the electrode member 205 stops up the cylinder 201.

2 Claims, 12 Drawing Sheets

HEATING ROLLER FOR FIXING

This application is a divisional of Ser. No. 09/032,245 filed Feb. 27, 1998, now U.S. Pat No. 6,096,995.

BACKGROUND OF THE INVENTION

The present invention relates to a heating roller for fixing toner in especially an electrophotographic apparatus such as a printer.

Conventionally, toner fixing device in an electrophotographic apparatus such as a printer is constituted such that a heating roller having a heating means, and a press roller located to face each other, and printed paper is allowed to pass between these rollers so that toner is heated and fixed.

Moreover, as for the above-mentioned heating roller, a heating roller, which is constituted such that a heating element such as a halogen lamp is provided into a metallic pipe which is made of aluminum or stainless steel, etc. has been used, but there arose a problem that it needed not less than one minute for warming up because of its low heat effectiveness, and its electric power consumption also became high.

Therefore, there suggests a heating roller which is constituted such that a heating resistor is provided onto the outer circumferential surface of a cylinder made of a metallic pipe with an insulating layer made of an organic resin such as polyimide lying therebetween, and a cleavage layer is provided onto its surface (of. Japanese Patent Application Laid-Opens No. 55-72390/1990 and No. 62-200380/1987, etc).

In addition, there also suggests a heating roller for fixing which is constituted such that heating resistor is provided onto the inner circumferential surface of a cylinder with an insulating layer lying therebetween, and a cleavage layer is provided onto the outer circumferential surface of the cylinder (of. Japanese Patent Application Laid-Open No. 55-72390/1980, etc).

However, in the case of such a heating roller for fixing constituted such that a heating resistor is provided onto the circumferential surface of the cylinder with the insulating layer lying therebetween, during a long time use, there arose a problem that the cylinder and the heating resistor were easily short-circuited because of poor insulation of the insulating layer.

In the present invention, therefore, a heating roller for fixing, which is constituted such that a heating resistor is provided onto the circumferential surface of the cylinder with the insulating layer lying therebetween, and a cleavage layer is provided onto the outermost circumferential surface, is characterized in that the maximum height of surface roughness (Rmax) on the surface of the heating resistor of the cylinder is in the range of 0.8 to 50 $\mu$m.

Furthermore, the present invention is characterized in that no protrusion whose height exceeds 50 $\mu$m exists on the surface of the cylinder, and a number of the protrusions whose height is 20 to 50 $\mu$m is less than 2 per 1 $cm^2$, and a number of the protrusion whose height is 10 is 20 $\mu$m is less than 5 per 1 $cm^2$.

Namely, since the above-mentioned cylinder is mostly formed by drawing and converting a metallic pipe, many protrusions exist on its surface, and its maximum height of surface roughness (Rmax) is about 70 to 130 $\mu$m. For this reason, the thickness of the insulating layer becomes thinner at the protruded portions, and it easily causes poor insulation. In the present invention, accordingly, it was found that poor insulation could be prevented by removing the protrusion which exist on the surface of the above-mentioned cylinder, so that the maximum height of surface roughness (Rmax) is in the range of 0.8 to 50 $\mu$m.

In addition, even if the maximum height is within the said range, a lot of protrusions easily cause poor insulation. So, in this invention, it was found that when poor insulation can be further pretended by means that no protrusion whose height exceeds 50 $\mu$m exists on the surface of the said cylinder, and a number of the protrusion whose height is 20 to 50 $\mu$m is less than 2per 1 $cm^2$, and a number of the protrusion whose height is 10 to 20 $\mu$m is less than 5 per 1 $cm^2$.

The present invention relates to a heating roller for fixing toner in especially an electrophotographic apparatus such as a printer, and relates to a cylindrical heater which is used as a heater for hot water, and a air-conditioning heater.

Conventionally, a toner fixing device in the electrophotographic apparatus such as a printer is constituted such that a heating roller having a heat means, and a press roller located to face each other, and a printed paper is allowed to pass between these rollers so that toner is heated and fixed.

Moreover, as for the above-mentioned heating roller, a heating roller, which is constituted such that a heating element such as a halogen lamp is provided into a metallic pipe made of aluminum or stainless steel, etc. but there arose a problem that is needed not less than one minute for warming up because of its low effectiveness, and its electric power consumption also became high.

Therefore, there suggests a heating roller which is constituted such that a heating resistor is provided onto the outer circumferential surface of the cylinder made of a metallic pipe with an insulating layer made of an organic resin such as polyimide lying therebetween, and a cleavage layer is provided onto its surface (of. Japanese Patent Application Laid-Opens No. 55-72390/1980 and No. 62-200380/1987, etc).

As shown in FIG. 11, there also suggests a heating roller which is constituted such that a spiral slots 131 are formed on the full length of the heating resistor 103 which is formed on the whole surface of the cylinder 101 (of. Japanese Patent Application Publication No. 6-36121/1994 and Japanese Patent Application Laid-Open No. 2-308291/1990). In this way, a resistance value of the heating resistor 103 is adjusted to be a prescribed value by forming the spiral slots 131, and the resistance value can be partially adjusted by changing intervals between the slots 131. For example, the temperature of both ends of the heating roller for fixing easily drops by its heat radiation, but it is possible to heat uniformly by adjusting the intervals between the slots 131 and raising beforehand its resistance value of both ends of the heating resistor 103.

Furthermore, a cylindrical heater having the same construction as the above-mentioned heater is used as a heater for hot water which heats water running inside, an air-conditioning heater, and a heater for heating a element, etc.

However, in the heating roller for fixing shown in FIG. 11, it is difficult to accurately adjust its resistance value partially because the spiral slots 131 are shaped on the full length thereof.

Namely, in the heating roller for fixing, since heat radiation easily occurs on its ends as mentioned above, it needs to raise the resistance of its ends. Furthermore, it needs to adjust the heat value by delicately changing the resistance value along an axial direction of the cylindrical like that it needs to vary the heat value on a paper-passing part from that on the other part. On the other hand, in the spiral slots 131 shown in FIG. 11 extending to the full length thereof, it is very difficult to accurately form the slots 131 by delicately changing its interval since the resistance value can be adjusted only by the intervals of the slots 131.

Accordingly, the present invention provides a cylindrical heater having a heating resistor on a surface of the cylinder with an insulating layer lying therebetween is characterized in that the heating resistor is divided into plural zones along an axial direction of the cylinder, and slots for adjusting the resistance are respectively shaped in each zone.

Namely, the slots are not formed on the full length of the surface, the slots are formed respectively in each zone along an axial direction. As a result, the resistance value can be adjusted partially and easily.

In addition, the present invention is characterized in that the slots formed almost parallel at a certain angle with respect to the axial direction of the cylinder. Furthermore, the almost parallel slots mean that respective slots are arranged almost parallel when the heating resistor is unfolded in plain style.

In addition, the present invention is characterized in that the slots are composed of slots extended along the axial direction of the cylinder and branch slots connected thereto.

The present invention relates to a heating roller for fixing toner in especially an electrophotographic apparatus such as a printer, and relates to a cylindrical heater which is used as a heater for hot water and an air-conditioning heater.

Conventionally, a toner fixing device in the electrophotographic apparatus like as a printer is constituted such that a heating roller for fixing having a heat means, and a press roller located to face each other, and a printed paper is allowed to pass between these rollers so that toner is heated and fixed.

Moreover, as for the above-mentioned heating roller, a heating roller, in which a heating element such as a halogen lamp is provided into a metallic pipe made of aluminum or stainless steel, etc. has been used but there arose a problem that is needed not less than one minute for warming up because of its low heat effectiveness, and its electric power consumption also became high.

Therefore, as shown in FIG. 18, there suggests a heating roller for fixing which is constituted such that a heating resistor 203 coated with nickel or the like is formed on the outer circumferential surface of a cylinder 201 composed of a metallic pipe with an insulating layer 202 made of glass, ceramics, and resin on its both ends, and the rest of the heating resistor 203 is covered by a cleavage layer 206 (of. Japanese Patent Application Laid-Open No. 62-200389/1987 and No. 58-40571/1983). In this heating roller for fixing, while spinning the cylinder 201, a load dispatching member (not shown) is brought into contact with the outer circumferential surface of the electrode members 205 on both ends, and while being scraped, power is fed, so it is possible to energize and heat the heating resistor 203.

Moreover, there is a heater for hot water constituted such that a ceramic heater is put onto the outer circumference of a stainless steel pipe to heat the water running inside the pipe, and it is also used as an air-conditioning heater and heater for heating an element or the like having the same construction.

However, in the heating roller for fixing shown in FIG. 18, there arose a problem that heat radiation easily occurs since the heating resistor 203 is located on the outer circumferential surface of the cylinder 201, and the cylinder 201 is hollow. Therefore, there were some inconveniences that it is impossible to heat uniformly by heat radiation on its ends, and its electric consumption becomes high because of its great heating loss.

Moreover, since the electrode members 205 were located on the outer surface, when using in fixing apparatus, there arose another problems that some noises occur by catching toner, and the electrode members 205 are easily deteriorated by water vapor, chlorine gas, etc., generated from the paper.

Therefore, the present invention provides a cylindrical heater, which is constituted such that a heating resistor is provided onto the inner surface thereof, and electrode members connected to the heating resistor is provided onto both ends of the inner side of the cylinder, is characterized in that electrode member stops up a hollow of the cylinder.

Furthermore, the present invention provides a cylindrical heater which is characterized in that a load dispatching member for supplying power feeds a power while being scraped on the electrode member, and a ratio L/D of a distance L of between a scrape surface and an end surface to an inner diameter D of the cylinder, is not more than 0.6.

By means of the present invention, it is possible to prevent from the heat radiation, to heat uniformly, and to reduce the heat loss and save the electric power by forming the heating resistor on the inner surface of the cylinder and by forming the electrode member to stop up a hollow thereof.

Furthermore, since the electrode member is provided into the cylinder, it is possible to prevent toner from being caught and the corrosion due to water vapor or chlorine gas when using as the heating roller for fixing.

BRIEF DESCRIPTION OF THE DRAWINGS

FIGS. 2(*a*) and 2(*b*) are partially cutaway perspective view of a cylinder which is used in the heating roller for fixing of the present invention.

EMBODIMENTS

The following describes embodiments of the present invention on reference with the drawings.

Figure 1:
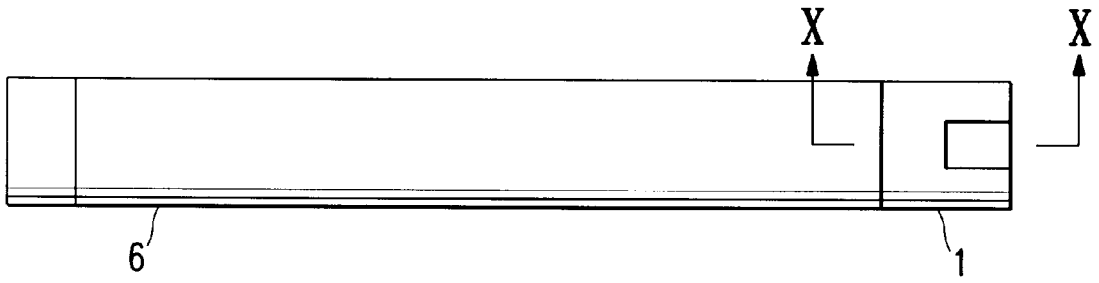
FIG. 1(*a*) is a side elevation view illustrating a heating roller for fixing of the invention.

As shown in FIG. 1, a heating roller for fixing of the present invention is constituted such that an insulating layer 2 is provided onto an inner circumferential surface 1*a* of a cylinder 1 made of a metallic pipe, and a heating resistor 3 is formed on the insulating layer 2, and an electrode member 5 is joined to an end portion of the heating resistor 3 by using a conductive adhesive 4, and a cleavage layer 6 is provided on an outer circumferential surface of the cylinder 1. FIG. 1(*b*) shows only one end of the roller, but the conducting terminal member 5 is sealed to both the ends.

This electrode member 5 is a cover-type member for stopping up a hollow of the cylinder 1 and a projection is formed at its center portion so that its end surface is a scrape surface 5*a* with a load dispatching member 7. When the heating roller for fixing is used, while the cylinder 1 is being rotated, the load dispatching member 7 is brought into contact with the scrape surface 5*a* of the electrode member 5 on the end portion of the cylinder 1, and while the load dispatching member 7 is being scraped on the scrape surface 5*a*, a power is supplied to energize the heating resistor 3 so that a heat is generated.

In addition, the metallic pipe composing the cylinder 1 is made of metal with heat conductivity of not less than 0.03 cal/° C.·cm·sec, and more concretely, aluminum, aluminum alloy, iron, iron alloy or stainless, etc. is used, and its thickness is 0.5 to 1 mm.

Figure 2:
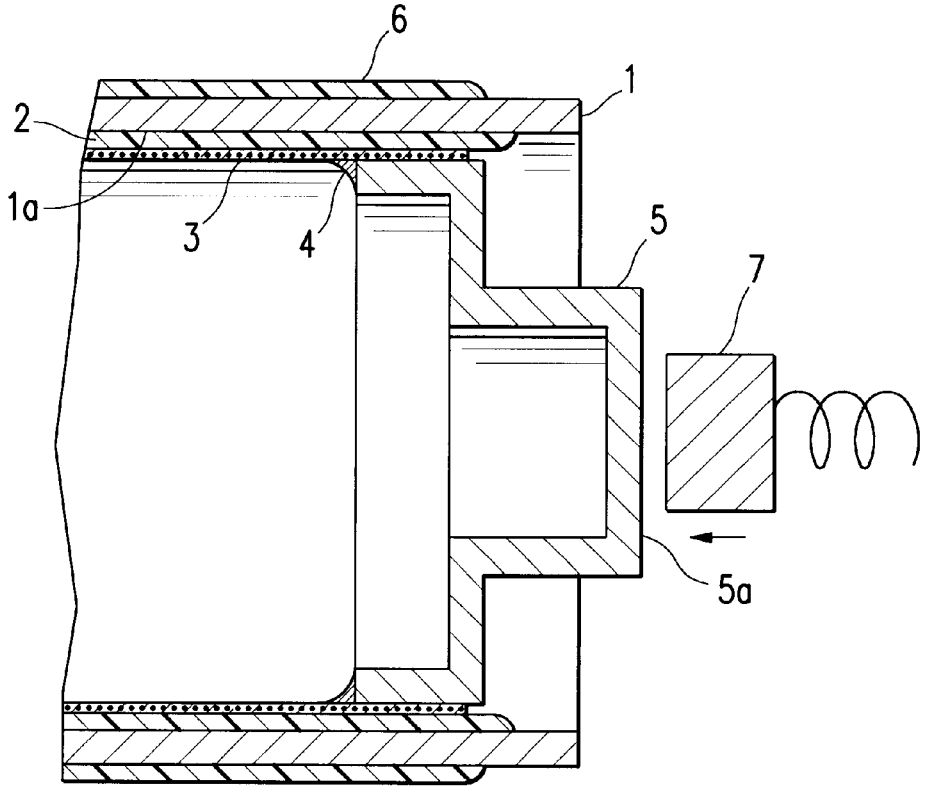
FIG. 2 is a cross-sectional view taken on line X—X in (a).
Figure 2A:
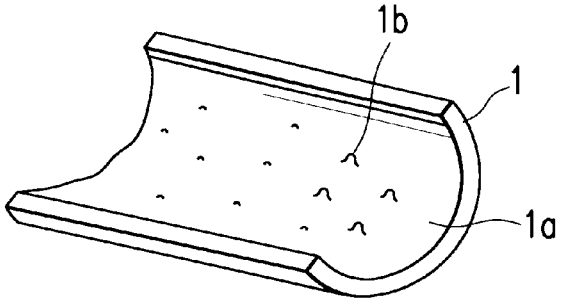
Figure 2B:
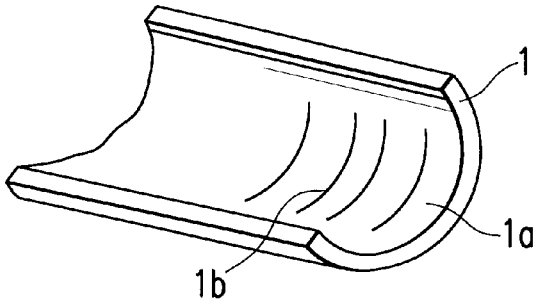

As shown in FIGS. 2(*a*) and 2(*b*), dotted or linear protrusion 1*b* which are caused by the manufacturing step exist on the inner circumferential surface 1*a* of the cylinder 1, but in the present invention, a maximum height (Rmax) of surface roughness of the inner circumferential surface 1*a* including the protrusion 1*b* is in the range of 0.8 to 50 $\mu$m.

The reason of limiting the above range is that if the maximum height (Rmax) is less than 0.8 $\mu$m, bonding strength of the insulating layer 2 is deteriorated, and thus the insulating layer 2 might be peeled partially during use, whereas if the maximum height exceeds 50 $\mu$m, prescribed electrical insulating properties cannot be maintained.

Further, protrusions whose height exceeds 50 $\mu$m do not exist on the inner circumferential surface 1*a*, and a number of protrusions whose height is in the range of 20 to 50 $\mu$m is less than 2 per 1 $cm^2$ and a number of protrusion whose height is in the range of 10 to 20 $\mu$m is less than 5 per 1 $cm^2$.

Namely, even if the height is in the above range of the surface roughness, a lot of protrusion 1*b* cause insufficient insulation easily. For this reason, as a result of various experiments, it was found that a number of protrusions 1*b* should be in the prescribed range.

Figure 3:
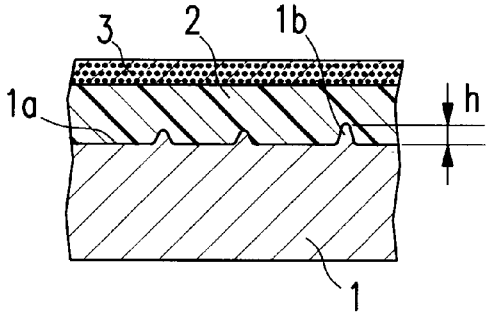
FIG. 3 is an enlarged sectional view of the inner circumferential side of the cylinder in the heating roller for fixing of the present invention.

For example, as shown in the cross-sectional view of the cylinder 1 of FIG. 3, the insulating layer 2 becomes thinner in portions where the protrusions 1*b* exist, and thus the insulating quality is lowered, but in the present invention, since the maximum height (Rmax) is set to not wire than 50 $\mu$m, and thus the protrusions 1*b* whose height h exceeds 50 $\mu$m do not exist. For this reason, a portion of the insulating layer 2 whose thickness becomes thin extremely is not generated. Further, as for the protrusions 1*b* whose height h is not more than 50 $\mu$m, when its number is reduced, a portion of the insulating layer 2 whose thickness becomes thinner can be reduced. As a result, the electrical insulating properties of the insulating layer 2 can be maintained satisfactorily.

In the present invention, in order to measure the surface roughness of the inner circumferential surface 1*a* of the cylinder 1 and a number of the protrusions 1*b*, as shown in FIG. 2, for example, the cylinder 1 of the heating roller for fixing is cut along its axial direction and it is soaked into water for several hours. As a result, the insulating layer 2 is peeled, and the exposed inner circumferential surface 1*a* may be measured.

The measurement of the concrete surface roughness may be made according to JIS B 0601, and the surface roughness of the inner circumferential surface 1*a* may be measured by using a feeler-type surface roughness meter or the like. Moreover, as for a number of the protrusions 1*b*, a plurality of portions of the inner circumferential surface 1*a* are measured and averaged by using the similar surface roughness meter, and a number of the protrusions 1*b* whose height is 10 to 20 $\mu$m existing per 1 $cm^2$ and a number of the protrusions 1*b* whose height is 20 to 50 $\mu$m existing per 1 $cm^2$ may be calculated respectively.

In another method, in the case where it is hard to directly measure the inner circumferential surface 1*a*, a methyl cellulose sheet which was swelled by methyl acetate is stuck to the inner circumferential surface 1*a*, and after its surface is transferred, the sheet is peeled to be dried, and the surface roughness or the like can be measured on the sheet.

In another simple measuring method, the inner circumferential surface 1*a* of the cylinder 1 is observed through an endoscope or the like so that a number of the protrusions 1*b* can be counted.

In the case where the protrusions 1*b* are dotted ones as shown in FIG. 2(*a*), a number of the protrusions 1*b* is counted, and a number of the protrusions 1*b* existing per 1 $cm^2$ is calculated. Moreover, in the case where the protrusions 1*b* are linear ones as shown in FIG. 2(*b*), one line is one protrusion, and a feeler is moved in the direction vertical to the direction of the line to measure, and a number of the protrusions 1*b* per 1 cm of the measured length is obtained so that the obtained value is determined as a number of the protrusions 1*b* per 1 $cm^2$.

In addition, in order to adjust the surface roughness and a number of the protrusions 1*b* on the inner circumferential surface 1*a* of the cylinder, a chemical treatment or the like may be given in the manufacturing process of the cylinder 1. For example, the cylinder 1 is formed by a drawing process or the like of the aforementioned metallic pipe, and the inner circumferential surface 1*a* is ground as the need arises, but thereafter, the inner circumferential surface 1*a* is treated with chemicals such as caustic soda so that the protrusions 1*b* are reduced, and thus the surface roughness can be reduced. The time of the chemical treatment is adjusted so that the surface roughness and a number of protrusions 1*b* fall in the above range.

In addition, the insulating layer 2 is made of resins with excellent heat resistance such as polyimide, phenol, polyimide amide, polyamide imide, silicon and borosiloxance, and its thickness varies according to dielectric strength, but in the case of polyimide, it is preferable that the thickness is 10 to 200 $\mu$m. The reason for this is that electrical insulation properties are maintained satisfactorily, and 20 to 150 $\mu$m is preferable and 50 to 70 $\mu$m is more preferable.

Further, as the heating resistor 3, a mixture of an electrically conductive agent and a synthetic resin or glass composing matrix is used. Examples of the electrically conductive agent are metallic materials such as Ag, Ni, Au, Pd, Mo, Mn and W, and metallic compounds such as $Re_2O_3$, $Mn_2O_3$ and $LaMnO_3$, and at least one kind of them is used. Moreover, as the glass composing matrix, either of crystalline glass and non-crystalline glass may be used, but when crystalline glass is used, a change in a resistance value can be reduced also by thermal cycle.

The synthetic resin or glass composing the matrix is required for improving deposition strength, and they are included in the range of 10 to 90 weights. Moreover, it is preferable that the thickness of the heating resistor 3 is set to 5 to 100 $\mu$m.

In another method, the heating surface 3 is formed by simple metal, and it can be formed also by metallizing or the like.

Further, examples of the electrode member 5 are materials whose difference in thermal expansion coefficient with the cylinder 1 is within $10\times10^{-6}$/° C., electric resistivity is not more than 10 $\mu$Q·cm, and melting point is not less than 800° C. More specifically, brass, copper, copper alloy, stainless, etc. or materials obtained such that the surfaces of these metal were subject to the metallizing treatment with nickel or the like are used.

The following describes the manufacturing method of the heating roller for fixing of the present invention.

First, after the cylinder 1 composed of a metallic pipe is processed in a prescribed shape, and the surface roughness of the inner circumferential surface 1*a* and a number of the protrusions 1*b* are adjusted by the aforementioned method, the insulating layer 2 is applied to the inner circumferential surface 1*a* by spin coating, spray coating, dipping, etc. so as to be stoved in air of 200 to 450° C. or in nitrogen atmosphere. A heating resistance component is mixed with an organic solvent, binder, dispersant or the like to be in paste form, and it is applied to the insulating layer 2 by screen printing, dipping, spray coating or the like and is calcined at 400 to 500° C. to form the heating resistor 3.

Then, after the heating resistor 3 is subject to laser trimming as the need arises so that a resistance value is adjusted, the outer circumferential surface of the cylinder 1 is coated with the cleavage layer 6. Finally, when the electrode member 5 is joined to a prescribed portion by the conductive adhesive 4, the heating roller for fixing of the present invention can be obtained.

In the embodiments in FIGS. 1 and 2, when the heating resistor 3 is provided to the cylinder 1 on the side of the inner circumferential surface 1*a,* a fire or the like hardly occurs, and the heating roller for fixing with high stability can be obtained. However, the present invention is not limited to this embodiment, so the present invention may be constituted such that a heating resistor is provided to the outer circumferential surface of the cylinder 1 with an insulating layer lying therebetween, and its surface has a cleavage layer. In this case, surface roughness of the outer circumferential surface and a number of protrusions on the cylinder may be set within the aforementioned range.

Embodiment 1

The following describes embodiments of the present invention.

A heating roller for fixing shown in FIG. 1 was manufactured experimentally. The cylinder 1 was made of aluminum so that an outer diameter was 20 mm, length was 280 mm and thickness was 1.0 mm. The cylinders 1 whose surface roughness of the inner circumferential surface 1*a* was varied by changing the treatment time using caustic soda were prepared, and the maximum height (Rmax) of the inner circumferential surfaces 1*a* of the respective cylinders 1 was measured by the aforementioned method. The heating resistors 3 made of a mixture of conductive agent and glass were formed on the inner circumferential surfaces 1*a* with the insulating layers 2 with a thickness of 30 to 60 $\mu$m made of polyimide lying therebetween, and resistance values of some of the heating resistors 3 were adjusted by laser trimming and resistance values of the other heating resistors 3 were not adjusted.

Aluminum foil was spread all over the heating resistors 3, and when a voltage of 1.5 kV was applied respectively between the aluminum foil and the cylinders 1, a check was made as to whether or not breakdown occurs on the insulating layers 2 so that insulation properties were evaluated.

The result is shown in Table 1. According to this result, it was found that when the maximum height (Rmax) of the surface roughness of the inner circumferential surfaces 1*a* of the cylinders 1 was set to fall in the range of 0.8 to 50 $\mu$m, the breakdown did not occur.

TABLE 1

| No. | Composition of heating resistor | Adjustment of resistance | Surface roughness of inner circumferential surface of cylinder (Rmax) | Evaluation of insulation properties |
|---|---|---|---|---|
| 1 | Ag—Ni 20% + | None | 0.8 $\mu$m | ○ |
| 2 | Polyimide 80% | | 1.0 | ○ |
| 3 | | | 5.0 | ○ |
| 4 | | | 10.0 | ○ |
| 5 | | | 15.0 | ○ |
| 6 | | | 30.0 | ○ |
| 7 | | | 40.0 | ○ |
| 8 | | | 50.0 | ○ |
| *9 | | | 55.0 | x |
| 10 | Ag—Ni 20% + | Laser trimming | 0.8 $\mu$m | ○ |
| 11 | Polyimide 80% | | 1.0 | ○ |
| 12 | | | 5.0 | ○ |
| 13 | | | 10.0 | ○ |
| 14 | | | 15.0 | ○ |
| 15 | | | 30.0 | ○ |
| 16 | | | 40.0 | ○ |
| 17 | | | 50.0 | ○ |
| *18 | | | 55.0 | x |

*is out of the scope of the present invention.

Embodiment 2

Next, the heating rollers for fixing were manufactured in the similar manner to Embodiment 1 except that a matrix component of the heating resistor 3 was lead glass and adjustment was made so that the surface roughness of the inner circumferential surface 1*a* of the cylinder 1 falls in the range of 0.8 to 50 $\mu$m. A number of dotted protrusions of 10 to 20 $\mu$m and 20 to 50 $\mu$m in arbitrary 10 places on the inner circumferential surfaces 1*a* of the cylinders 1 was checked, and the average value was calculated.

Thereafter, the insulation properties were evaluated in the same manner as Embodiment 1.

The result is shown in Table 2. According to the result, the heating rollers for fixing where 5 or more protrusions 1b with height of 10 to 20 μm exist per 1 $cm^2$, or two or more protrusions with height of 20 to 50 μm exist per 1 $cm^2$ on the inner circumferential surfaces 1*a,* could not maintain insulation properties. On the contrary, the heating roller for fixing where less than 5 protrusions 1*b* with height 10 to 20 μm exist per 1 $cm^2$ and less than two protrusions 1*b* with height of 20 to 50 μm exist per 1 $cm^2$ on the inner circumferential surfaces 1*a,* could maintain insulation properties satisfactorily.

TABLE 2

| No. | Composition of heating resistor | Adjustment of resistance | A number of protrusions per 1 $cm^2$ 10~20 μm | 20~50 μm | Evaluation of insulation properties |
|---|---|---|---|---|---|
| 19 | Ag—Ni 20% + | None | 0.5 | 1.0 | ○ |
| 20 | Lead glass 80% | | 1.0 | | ○ |
| 21 | | | 2.0 | | ○ |
| 22 | | | 3.0 | | ○ |
| *23 | | | 5.0 | | x |
| *24 | | | 7.0 | | x |
| *25 | | | 10.0 | | x |
| *26 | | | 20.0 | | x |
| *27 | | | 30.0 | ↓ | x |
| 28 | Ag—Ni 20% + | Laser | 0.5 | 1.0 | ○ |
| 29 | Lead glass 80% | trimming | 1.0 | | ○ |
| 30 | | | 2.0 | | ○ |
| 31 | | | 3.0 | | ○ |
| *32 | | | 5.0 | | x |
| *33 | | | 7.0 | | x |
| *34 | | | 10.0 | | x |
| *35 | | | 20.0 | | x |
| *36 | | | 30.0 | ↓ | x |
| 37 | Ag—Ni 20% + | None | 2.0 | 0.5 | ○ |
| 38 | Lead glass 80% | | | 1.0 | ○ |
| 39 | | | | 2.0 | x |
| 40 | | | | 3.0 | x |
| *41 | | | | 5.0 | x |
| *42 | | | | 7.0 | x |
| *43 | | | | 10.0 | x |
| *44 | | | | 20.0 | x |
| *45 | | | ↓ | 30.0 | x |
| 46 | Ag—Ni 20% + | Laser | 2.0 | 0.5 | ○ |
| 47 | Lead glass 80% | trimming | | 1.0 | ○ |
| 48 | | | | 2.0 | x |
| 49 | | | | 3.0 | x |
| *50 | | | | 5.0 | x |
| 51 | | | | 7.0 | x |
| *52 | | | | 10.0 | x |
| *53 | | | | 20.0 | x |
| *54 | | | ↓ | 30.0 | x |

*is out of the scope of the present invention.

Embodiment 3

Next, the heating rollers for fixing were manufactured in the similar manner to Embodiment 2 by using the cylinder 1 where linear protrusions 1*b* exist on the inner circumferential surface 1*a*.

A number of the protrusions 1*b* on the inner circumferential surfaces 1*a* were checked and insulation properties were evaluated in the same manner as Embodiment 2.

The result is shown in Table 3. According to the result, the heating rollers, where less than 5 protrusions 1*b* with height of 10 to 10 μm and less than two protrusions 1*b* with height of 20 to 50 μm exist per 1 $cm^2$ on the inner circumferential surfaces 1*a,* could maintain insulation properties satisfactorily.

TABLE 3

| No. | Composition of heating resistor | Adjustment of resistance | A number of protrusions per 1 $cm^2$ 10~20 μm | 20~50 μm | Evaluation of insulation properties |
|---|---|---|---|---|---|
| 55 | Ag—Ni 20% + | None | 0.5 | 1.0 | ○ |
| 56 | Lead glass 80% | | 1.0 | | ○ |
| 57 | | | 2.0 | | ○ |
| 58 | | | 3.0 | | ○ |
| 59 | | | 4.0 | | ○ |
| *60 | | | 5.0 | | x |
| *61 | | | 10.0 | | x |
| *62 | | | 15.0 | | x |
| *63 | | | 20.0 | ↓ | x |
| 64 | Ag—Ni 20% + | Laser | 0.5 | 1.0 | ○ |
| 65 | Lead glass 80% | trimming | 1.0 | | ○ |
| 66 | | | 2.0 | | ○ |
| 67 | | | 3.0 | | ○ |
| 68 | | | 4.0 | | ○ |
| *69 | | | 5.0 | | x |
| *70 | | | 10.0 | | x |
| *71 | | | 15.0 | | x |
| *72 | | | 20.0 | ↓ | x |
| 73 | Ag—Ni 20% + | None | 2.0 | 0.5 | ○ |
| 74 | Lead glass 80% | | | 1.0 | ○ |
| *75 | | | | 2.0 | x |
| *76 | | | | 3.0 | x |
| *77 | | | | 4.0 | x |
| *78 | | | | 5.0 | x |
| *79 | | | | 10.0 | x |
| *80 | | | | 15.0 | x |
| *81 | | | ↓ | 20.0 | x |
| 82 | Ag—Ni 20% + | Laser- | 2.0 | 0.5 | ○ |
| 83 | Lead glass 80% | trimming | | 1.0 | ○ |
| *84 | | | | 2.0 | x |
| *85 | | | | 3.0 | x |
| *86 | | | | 4.0 | x |
| *87 | | | | 5.0 | x |
| *88 | | | | 10.0 | x |
| *89 | | | | 15.0 | x |
| *90 | | | ↓ | 20.0 | x |

*is out of the scope of the present invention.

As mentioned above, according to the present invention, in the heating roller for fixing, which is constituted such that the heating resistor is provided onto the inner circumferential surface of the cylinder with the insulating layer lying therebetween and the cleavage layer is provided onto the outer circumferential surface, when the maximum height (Rmax) of the surface roughness of the inner circumferential surface of the cylinder is set to fall in the range of 0.8 to 50 μm, the electric insulating properties of the insulating layer can be maintained satisfactorily for a long time.

In addition, according to the present invention, when protrusion whose height exceeds 50 μm do not exist on the inner circumferential surface of the cylinder, a number of protrusions with height of 20 μm to 50 μm is less than 2 per 1 $cm^2$ and a number of protrusions with height of 10 to 20 μm is less than 5 per 1 $cm^2$, the electric insulation properties of the insulating layer can be maintained more satisfactorily.

As a result, the heating roller for fixing with high performance and excellent durability can be obtained easily.

The following describes embodiment of the present invention on reference with the drawings by illustrating of the heating roller for fixing.

Figure 4:
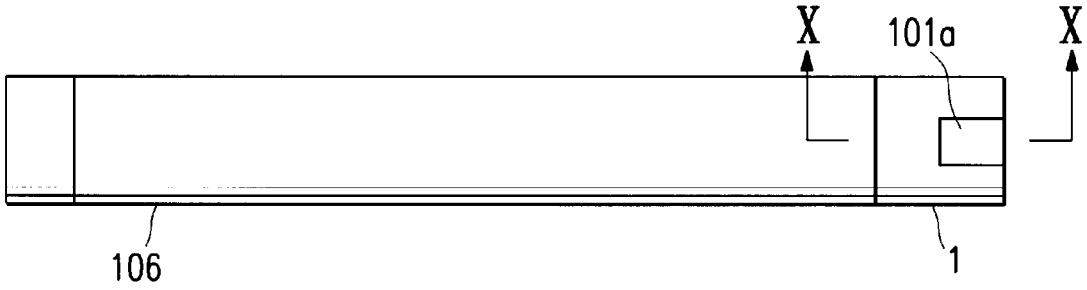
FIG. 4 is a side elevation view illustrating a heating roller for fixing of the present invention which is an alternate embodiment of the cylindrical heater.
Figure 5:
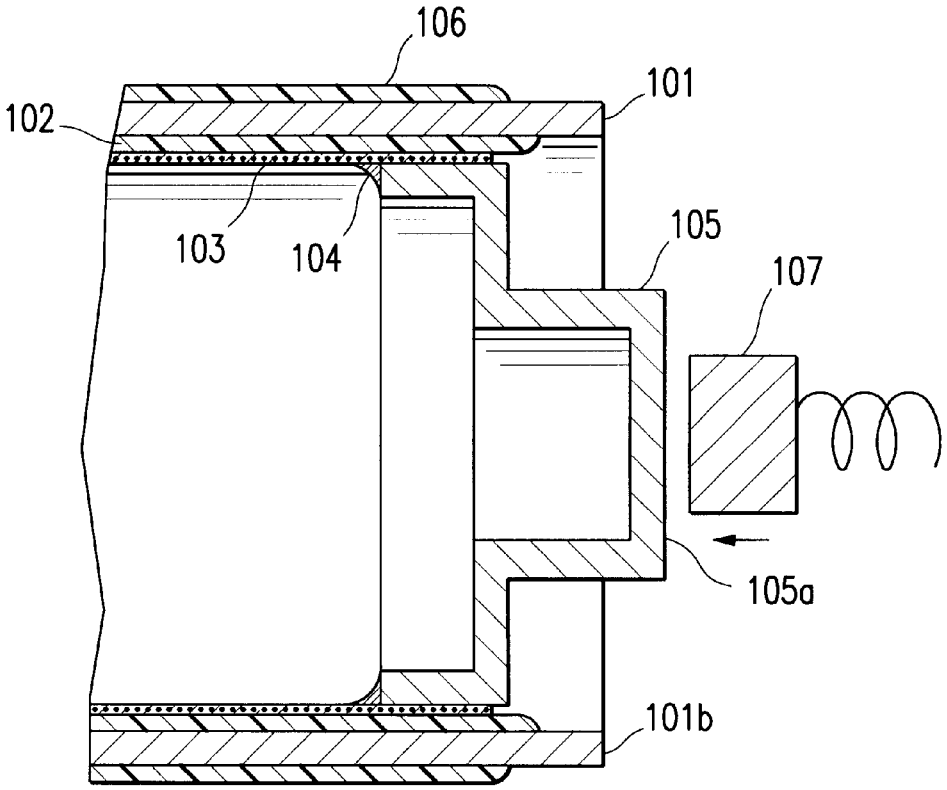
FIG. 5 is an enlarged sectional view taken on line X—X in FIG. 4.

As shown in FIGS. 4 and 5, the heating roller for fixing of the present invention is constituted such that an insulating layer 102 is provided on an inner circumferential surface of a cylinder 101 composed of a metallic pipe, and a heating resistor 103 is formed on the insulating layer 102, and an electrode member 105 is sealed to an end portion of the heating resistor 103 by using a conductive paste 104, and a cleavage layer 106 is provided onto an outer circumferential surface of the cylinder 101. Moreover, a notch 101*a* for recess at the time of rotation is provided to the end portion of the cylinder 101. FIG. 5 shows only one end of the roller, but an electrode member 105 is sealed to both the ends.

This electrode member 105 is a cover-type for stopping up a hollow of the cylinder 101 and a projection is formed at its center portion so that its end surface is a scrape surface 105*a* with a load dispatching member 107. When the heating roller for fixing is used, while the cylinder 101 is being rotated the load dispatching member 107 is brought into contact with the scrape surface 105*a* of the electrode member 105 on both the end portions of the cylinder 101, and while the load dispatching member 107 is being scraped on the scrape surface 105*a,* a power is supplied to energize the heating resistor 105 so that a heat can be generated.

In such a manner, when the heating resistor 103 is provided into the cylinder 101, and the hollow is stopped up with the electrode member 105, heat dispersion is prevented, and heat loss can be reduced.

Figure 6:
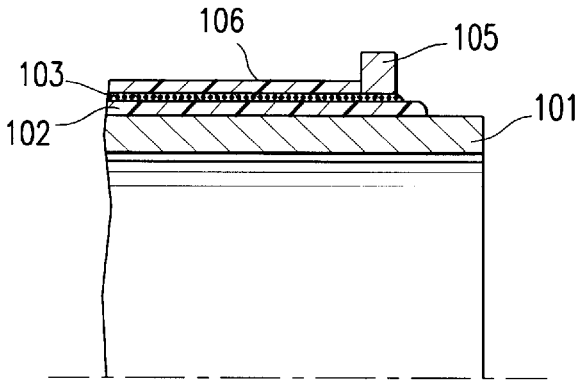
FIG. 6 is an enlarged sectional view of another alternate embodiment corresponding to FIG. 5.

In addition, as another embodiment, as shown in the cross-section view of the end portion in FIG. 6, the insulating layer 102 is provided onto the outer circumferential surface of the cylinder 101, the heating surface 103 is formed on the insulating layer 102, the ring-shaped electrode member 105 is sealed to the end portion of the heating resistor 103, and the cleavage layer 106 is provided onto the other portion of the heating resistor 103. In this case, the load dispatching member (not shown) is brought into contact with the outer circumferential surface of the electrode member 105 so that power can be supplied.

As mentioned above, in the heating roller for fixing of the present invention, the heating resistor 103 may be provided to either of the inner side and outer side of the cylinder 101. As mentioned in detail later, resistance adjusting means of the heating resistor 103 is important.

Figure 7A:
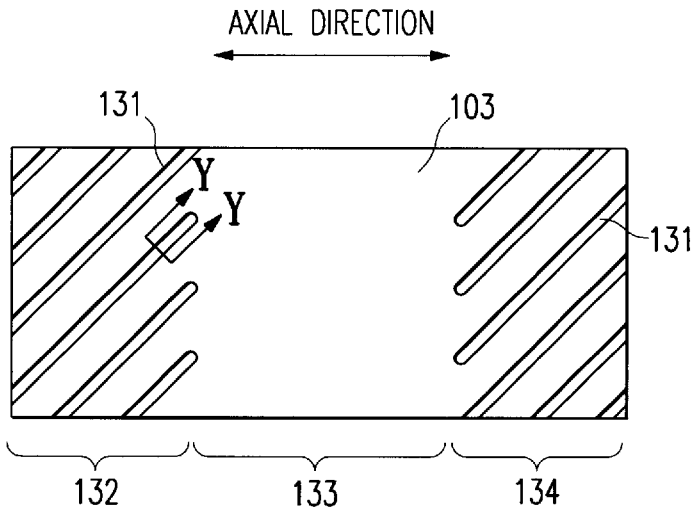
FIGS. 7(A) and 7(B) are developments of a heating resistor in the cylindrical heater of the present invention.
Figure 7B:
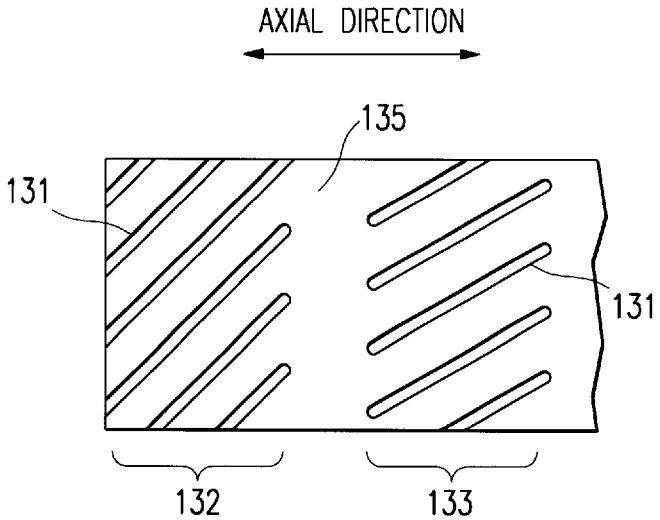

FIGS. 7(A) and 7(B) show developments of the heating resistor 103. Namely, the actual heating resistor 103 is provided to the inner or outer circumferential surface of the cylinder 101 and has a cylindrical shape, but FIGS. 7(A) and 7(B) show states that the heating resistor 103 is cut along one straight line in the axial direction and is developed. Here, the right-and-left direction of FIGS. 7(A) and 7(B) are the axial direction of the cylinder 101.

As shown in FIG. 7(A), the heating resistor 103 is divided into a plurality of zones, 132, 133 and 134 along the axial direction, and the resistance values are adjusted respectively. More specifically, slots 131 having a constant angle with respect to the axial direction are formed substantially parallel in the end zones 132 and 134 at constant intervals, and no slot 131 is formed in the central zone 133.

As a result, the resistance values of the end zones 132 and 134 can be raised by the slots 131, and a heat value on the end portion is increased, so even if heat dispersion occurs, a temperature of the whole heating resistor 103 can be uniform.

Next, in FIG. 7(B), the slots 131 having a constant angle with respect to the axial direction are formed substantially parallel in a plurality of the zones 132 and 133 at constant intervals. When an angle of the slots 131 in the zone 132 is made different from that in zone 133, the resistance values in the zones 132 and 133 are varied.

Further, a boundary portion 135 is provided between the zones 132 and 133 so that the slots 131 in both the zones are not connected with each other. This is because if the slots 131 in both the zones are connected with each other, it is difficult to measure the resistance value in each zone accurately, so the boundary portion 135 is required for adjusting the resistance values accurately.

In such a manner, in the present invention, since the heating resistor 103 is divided into a plurality of zones along the axial direction and the slots 131 are formed so that the resistance values are adjusted, the resistance values in each zone can be adjusted accurately. Moreover, a number of zones may be 2 to 10 suitably as the need arises.

As shown in FIGS. 7(A) and 7(B), when the slots 131 having a constant angle with respect to the axial direction are formed substantially parallel at constant intervals, the resistance values can be adjusted freely by changing the angle.

Figure 8:
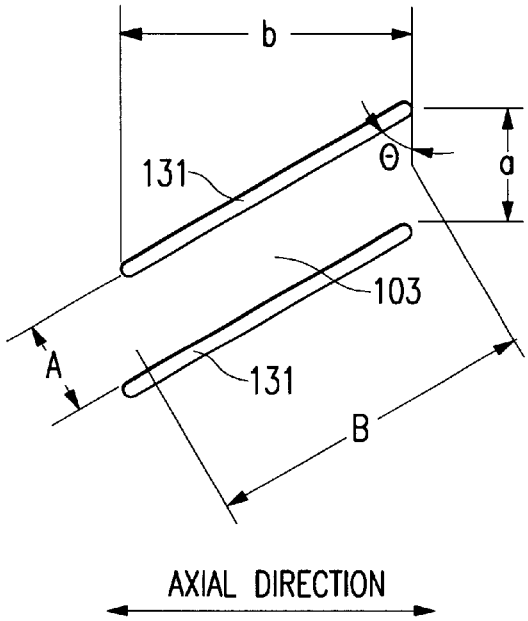
FIG. 8 is an enlarged view of a slot section in FIG. 7.

Namely, as shown in FIG. 8, in the case where the slots 131 which are tilted at an angle θ to the direction perpendicular to the axis are formed, when an interval between the slots in the direction perpendicular to the axis is a, and a length of the slots in the direction parallel with the axis is b, and an interval between the slots in the direction perpendicular to the slot 131 is A, and a length of the slot in the direction parallel with the slot 131 is B, $A=a\cdot\sin\theta$ $B=b/\sin\theta$ Here, when a resistance value of the interval portion between the slots 131 is R and a resistance value when θ=90° is $R_0$, $R_0\ b/a$ $R\ B/A=b/a\cdot\sin^2\theta$ Therefore, $R/R_0=1/\sin^2\theta$ In such a manner, when the angle θ is changed, the resistance value R can be changed. More specifically, as θ is reduced from 90° gradually, the resistance value R is gradually increased, and when θ=30°, the resistance value R can be as four time as large as when θ=90°.

Therefore, when the slots 131 having a form shown in FIGS. 7(A) and 7(B) are formed, the resistance value can be adjusted freely only by changing the angle θ, so the resistance value in each zone can be adjusted accurately.

Actually, it is preferable that the angle θ is in the range of 30 to 90°. This is because when the angle θ is less than 30°, the intervals A between the slots become too small, and the slots 131 are hard to be formed.

In addition, it is preferable that a ratio a/b of the interval a between slots and a length of the slots b is in the range of 0.1 to 0.6. This is because when the ratio is less than 0.1, the interval a between slots become too small, and the slots 131 are hard to be formed, whereas when the ratio exceeds 0.6, the current density is not stabilized, and thus an effect for changing the resistance value becomes deficient.

Figure 19:
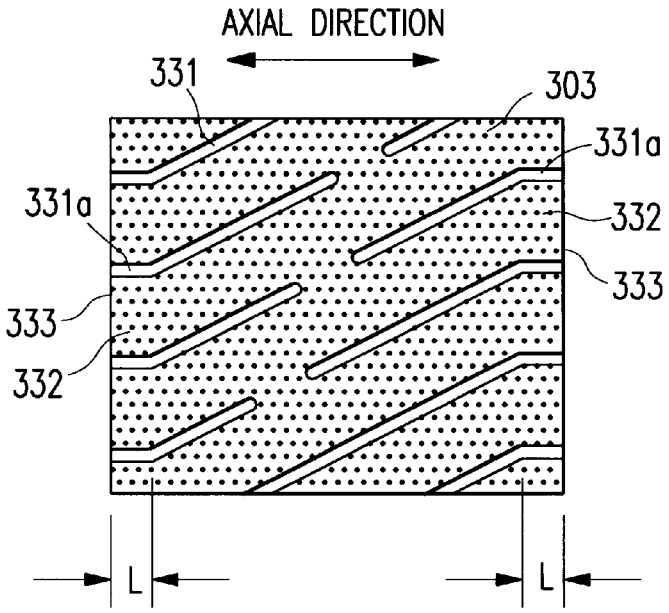
FIG. 19 is development of a heating resistor in the cylindrical heater of the present invention.

FIG. 19 shows different embodiment.

In addition, the slots 331 having a constant angle with respect to the axial direction in the central zone, the slots 331 are formed parallel in the end zones, the equal current territory can be formed. Therefore, when a power is supplied to energize both end of the heating resistor 303, both end of the resistor 303 molify current concentration into the neighborhood 333 of the slots 331. More, as shown the end zone enlarge drawing of FIG. 19(*a*), the boundry portions 331*c* are formed curved radius R between the oblique portion and the straight portion of the slots 331, therefore the boundry portions 331 are not cracked.

Figure 20A:
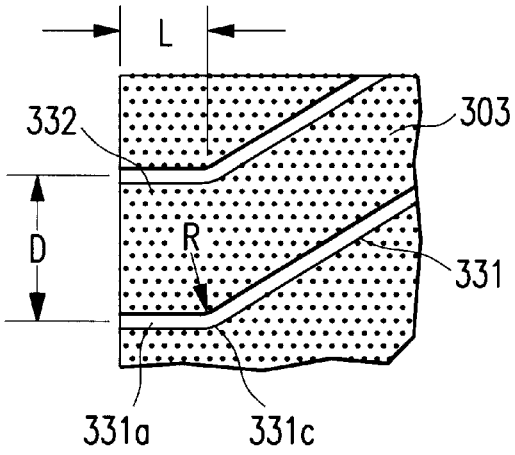
FIG. 20 is an enlarged view of end zone.
Figure 20B:
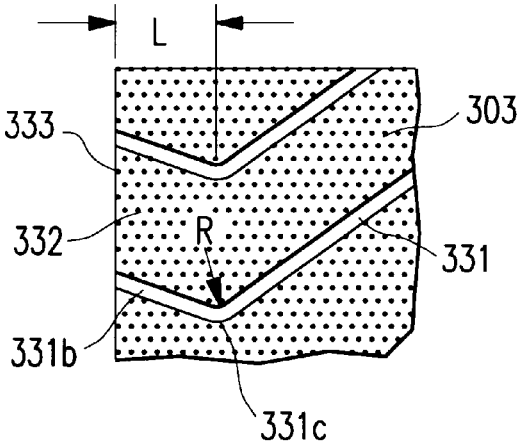

Further, as shown another embodiment in FIG. 20(*b*), when the slots 331 end are changed to the reverse direction curved portion 331 from the oblique direction of the slots 331 end, the equal current territory can be formed, therefore both end of the resistor 303 molify current concentration into the neighborhood 333 of the slots 331. In this case, the boundry portions 331*c* are formed curved radius R between the oblique portion and the straight portion of the slots 331, therefore the boundry portions 331*c* are not cracked.

In both cases, the length L along the axial direction in equal current territory is more than 2 mm, is preferably more than 5 mm.

In addition, in the forming method of the slots 131, after the heating resistor 103 is formed previously on the whole surface, its surface is processed so that the slots 131 are formed. In this case, when the process is performed by using a laser beam particularly, the slots 131 can be formed accurately, so this method is suitable.

Figure 9A:
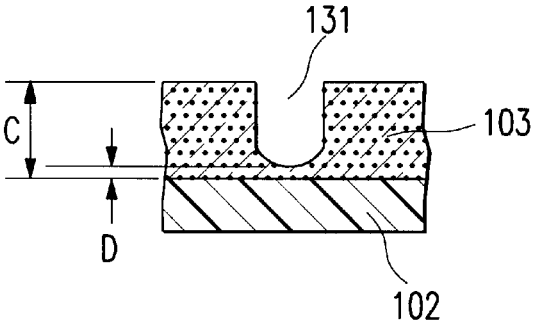
FIGS. 9(A), 9(B) are cross-sectional views taken on line Y—Y in FIG. 7.
Figure 9B:
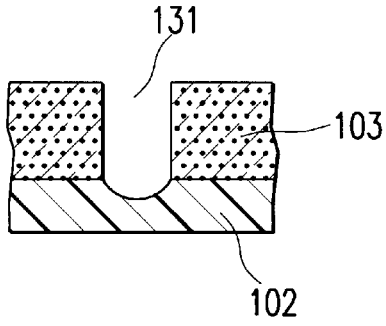

In this case, the section of the slots 131, as shown in FIG. 9(A), is such that the slots 131 are formed only in the heating resistor 103 and the heating resistor 103 is continued at the base, or as shown in FIG. 9(B), such that the slots 131 are formed up to in the insulating layer 102 and the heating resistor 103 can be parted completely. Here, as shown in FIG. 9(A), in the case of the form that the heating resistor 103 is continued at the base of the slots 131, it is preferable that a ratio D/C of a thickness of the base portion D to a thickness C of the heating resistor C is set to not more than 0.7.

The following describes another embodiment.

Figure 10:
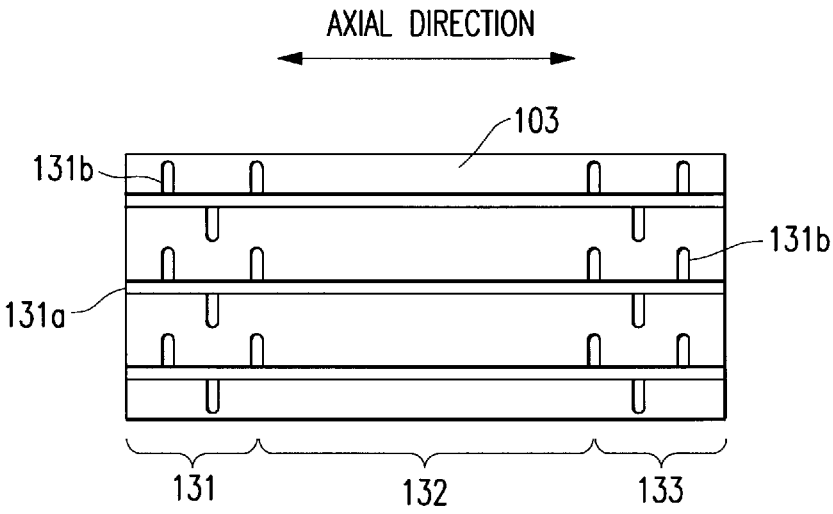
FIG. 10 is a development of the heating resistor according to another alternate embodiment of the present invention.
Figure 11:
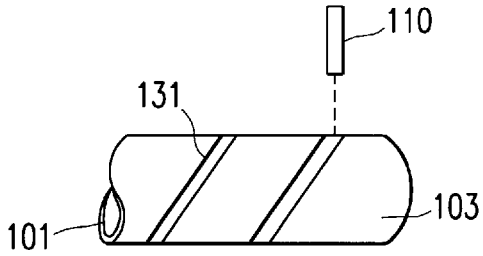
FIG. 11 is a side elevation view illustrating a conventional heating roller for fixing.

As shown in FIG. 10, slots 131*a* extended in the axial direction and branch slots 131*b* which are connected with the slots 131*a* can be formed in the heating resistor 103. In this case, the slots 131*a* do not take part in the adjustment of the resistance value, so the resistance value is adjusted by adjusting a length and intervals of the branch slots 131*b*. In FIG. 10, the heating resistor 103 is divided into end zones 131 and 133 and a central zone 132, and the branch slots 131*b* are formed in the end zones 131 and 133 so that the resistance value is kept high. Further, not shown, but slots for adjusting the resistance formed in each zone can be formed in a spiral shape. In this case, one slot is formed in the spiral shape, but it is preferable that an angle of the slot with respect to the perpendicular direction to the axis is set to not more than 6°.

In addition, a form of the slot for adjusting the resistance formed in each zone can be varied.

The metallic pipe composing the cylinder 101 is composed of metal with heat conductivity of 0.03 cal/° C.·cm·sec, and more specifically aluminum or aluminum alloy, stainless, etc. is used, and its thickness is 0.5 to 1 mm. Moreover, the insulating layer 102 is composed of an organic resin with excellent heat resistance such as polyimide, phenol, silicon and borosiloxane, and its thickness varies according to dielectric strength, but in the case of polyimide, the thickness of 10 to 200 $\mu$m is preferable. Moreover, the cleavage layer 106 is composed of a fluororesin, silicon or the like with excellent cleavage from toner.

Further, as the heating resistor 103, a mixture of an electrically conductive agent and a synthetic resin or glass composing matrix is used. Examples of the electrically conductive agent are metallic materials such as Ag, Ni, Au, Pd, Mo, Mn and W, and metallic compounds such as $Re_2O_3$, $Mn_2O_3$ and $LaMnO_3$, and at least one kind of them is used. Moreover, as the glass composing matrix, either of crystalline glass and non-crystalline glass may be used, but when crystalline glass is used, a change in the resistance value can be reduced also by thermal cycle. As its composition, the mixture containing 50 weight % or more PbO is suitable, and such a mixture whose softening point is not more than 500° C., namely, melting point is low is preferable.

The synthetic resin or glass composing the matrix is required for improving deposition strength, and they are included in the range of 10 to 50 weight % because if the content is less than 10 weight %, the deposition strength is lowered and resistance temperature coefficient is also lowered, whereas if the content exceeds 90 weight %, the resistance value becomes too large.

In addition, the thickness of the heating resistor 103 is 5 to 100 $\mu$m. This is because if the thickness is less than 5 $\mu$m, the resistance value becomes high and scattering is liable to occur, whereas the the thickness exceeds 100 $\mu$m, the heating resistor 103 is liable to be peeled.

Further, examples of the electrode member 105 are materials whose difference in thermal expansion coefficient with the cylinder 101 is within $10\times10^{-6}$/° C., electric resistance value is not more than 10 $\mu$Q·cm, and melting point is not less than 800° C. More specifically, brass, copper, copper alloy, stainless, etc. or materials obtained such that the surfaces of these metal were subject to the metallizing treatment with nickel or the like are used.

The following describes the manufacturing method of the heating roller for fixing of the present invention.

First, after the cylinder 101 composed of a metallic pipe is processed in a prescribed shape, and the insulating layer 102 composed of an organic resin is applied to the inner or outer circumferential surface by spin coating, spray coating, dipping, etc. so as to be stoved in air or 200 to 450° C. or in nitrogen atmosphere. A heating resistance component is mixed with an organic solvent, binder, dispersant or the like to be in paste form, and it is applied to the insulating layer 102 by screen printing, dipping, spray coating or the like and is calcined at 400 to 500° C. to form the heating resistor 103.

Then, after the heating resistor 103 is divided into a plurality of zones in the axial direction, and while the respective values being checked, the slots 131 are formed by the laser process. Thereafter, the electrode member 105 is joined to both the ends of the heating resistor 103 by using electrically conductive paste 104, and the outer circumferential surface of the cylinder 101 is coated with the cleavage layer 106.

The above embodiment describes only the heating roller for fixing, but the present invention can be used as another general cylindrical heater. For example, a cylindrical heater shown in FIGS. 4 through 6 is used to able to heat liquid such as water and fuel and to heat various elements, or the cylindrical heater can be used for heating.

As shown in FIG. 5, the heating rollers for fixing in which the heating resistor 103 were formed on the inner circumferential surface was manufactured experimentally so that their outer diameter is 20 mm and its length is 280 mm, and the slots 131 shown in FIGS. 7 and 8 were formed in the heating resistor 103.

Figure 12:
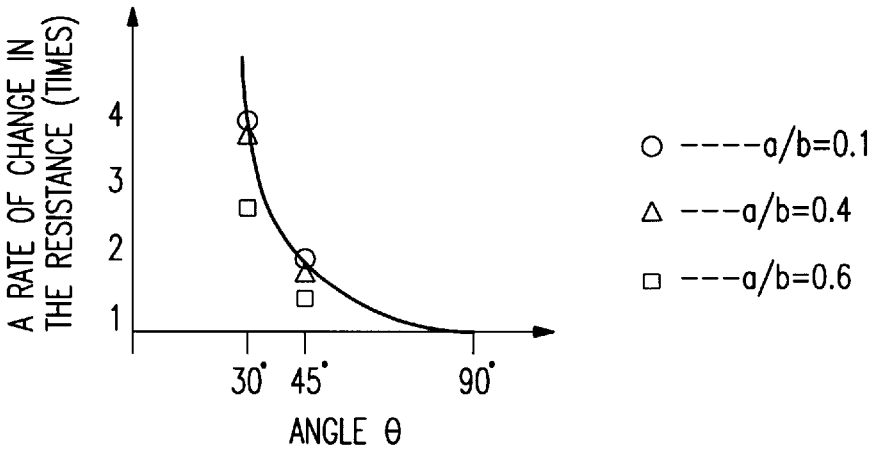
FIG. 12 is a graph illustrating a relation between an angle of the slot formed in the heating resistor and a rate of change in resistant.

A rate of change in the resistance value when the angle θ of the slots 131 and the ratio a/b of the intervals a between the slots and a length of the slots b are changed variously was measured. The result is shown in Table 4 and FIG. 12.

According to the result, since when a/b is 0.6, namely, large, a rate of change in the resistance becomes lower than a theoretical value (a curved line in FIG. 12), it is found that when a/b exceeds 0.6, the effect for adjusting the resistance becomes deficient. Therefore, it is suitable that a/b is in the range of 0.1 to 0.6.

TABLE 4

| | Angle θ | | Rate of change in resistance | | |
|---|---|---|---|---|---|
| No. | (°) | a/b | Theoretical value | Found value | Evaluation |
| 1 | 45 | 0.1 | 2.0 | 1.98 | ○ |
| 2 | | 0.4 | | 1.90 | ○ |
| 3 | | 0.6 | | 1.50 | Δ |
| 4 | 30 | 0.1 | 4.0 | 3.90 | ○ |
| 5 | | 0.4 | | 3.80 | ○ |
| 6 | | 0.6 | | 2.75 | Δ |

As mentioned above, according to the present invention, in the cylindrical heater which has a heating resistor on the surface of the cylinder with an insulating layer lying therebetween, the heating resistor is divided into a plurality of zones in the axial direction of the cylinder, and slots for adjusting resistance in each zone are formed. As a result, the resistance values can be adjusted partially and easily.

In addition, in the present invention, slots are formed substantially parallel at a constant angle with respect to the axial direction of the cylinder, or slots extended in the axial direction of the cylinder and branch slots which are connected with the slots are formed. As a result, the resistance value can be adjusted fine.

Further, when the heating roller for fixing is constituted such that a cleavage layer is provided onto the outer circumferential surface of the cylindrical heater, the heating roller for fixing having required resistance value distribution can be obtained easily.

The following describes embodiment of the present invention by illustrating the heating roller for fixing on reference with the drawings.

Figure 13:
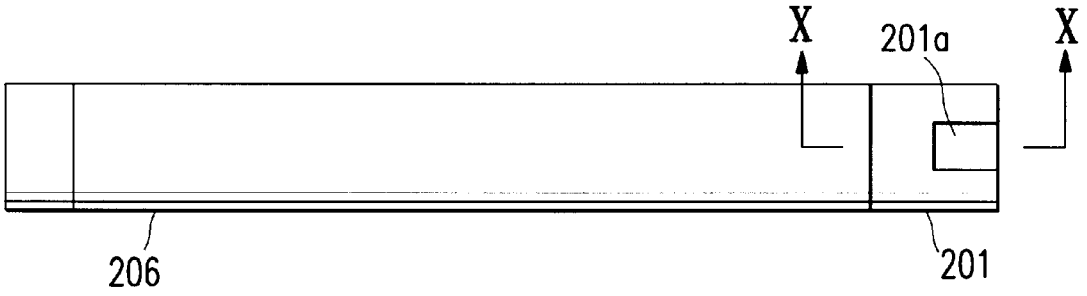
FIG. 13 is a side elevation view illustrating a heating roller for fixing of the invention which is an alternate embodiment of the cylindrical heater of the invention.
Figure 14:
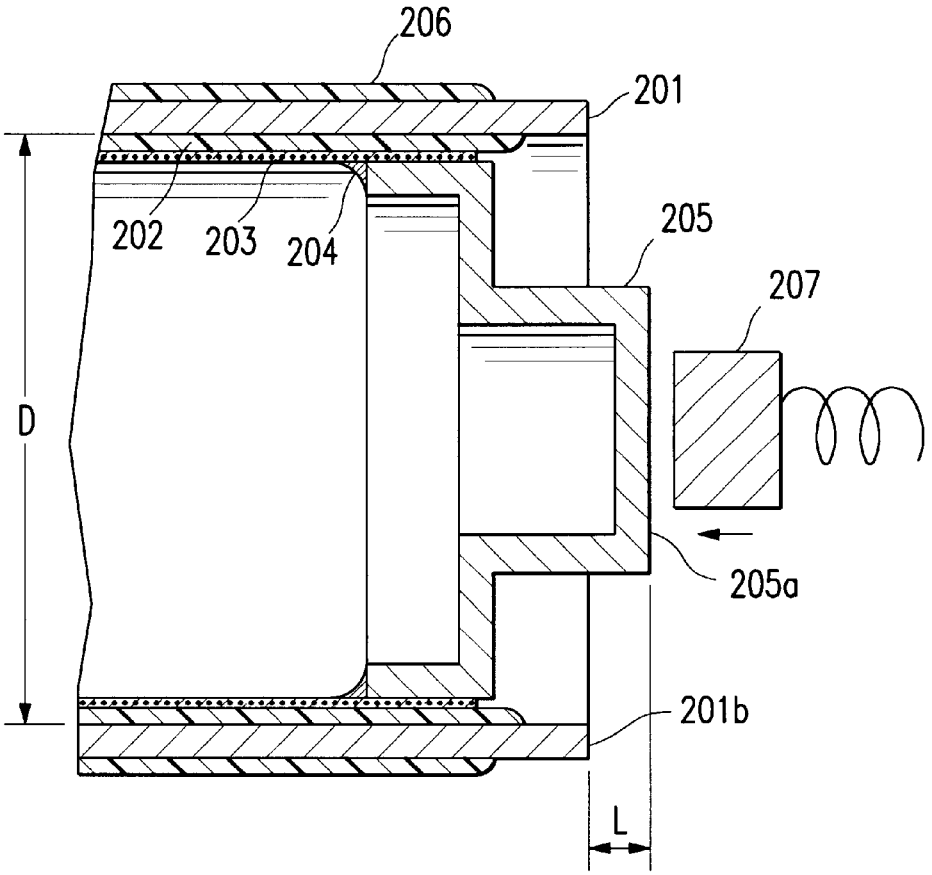
FIG. 14 is an enlarged sectional view taken on line X—X in FIG. 13.

As shown in FIGS. 13 and 14, the heating roller for fixing of the present invention is constituted such that an insulating layer 202 is provided onto an inner circumferential surface of a cylinder 201 composed of a metallic pipe, and a heating resistor 203 is formed on the insulating layer 202, and an electrode member 205 is sealed to an end portion of the heating resistor 203 by using a conductive paste 204, and a cleavage layer 205 is provided onto an outer circumferential surface of the cylinder 201. Moreover, a notch 201*a* for recess at the time of rotation is provided to the end of the cylinder 201. FIG. 14 shows only one end portion of the roller, but an electrode member 205 is sealed to both the ends.

This electrode member 205 is a cover-type member for stopping up a hollow of the cylinder 201 and a projection is formed at its center portion so that its end surface is a scrape surface 205*a* with a load dispatching member 207. When the heating roller for fixing is used, while the cylinder 201 is being rotated, the load dispatching member 207 is brought into contact with the scrape surface 205*a* of the electrode member 205 on both the end portions of the cylinder 201, and while the load dispatching member 207 is being scraped on the scrape surface 205*a* to energize the heating resistor 203 so that a heat can be generated.

At this time, since the heating resistor 203 is provided to the inner side of the cylinder 201, and the hollow of the cylinder 201 is stopped up with the electrode member 205, generated heat is hard to disperse. For this reason, heating can be performed uniformly, and heat loss can be reduced. FIG. 14 shows the form such that the electrode member 205 stops up the hollow of the cylinder 201 completely, but it is not necessary to stop up the hollow completely, so a hole may be provided partially. As detailed later, a closing rate by the electrode member 205 may be set to not less than 5%.

In addition, since the electrode member 205 is provided to the inside of the cylinder 201, catching of toner does not occur, and corrosion of the electrode member 205 due to water vapor, chlorine gas or the like can be prevented.

Further, in order to prevent moisture getting in to the insulating layer 202 and the end zone of heating resistor 203, the insulating layer 202 and the end zone of heating resistor 203 can be covered by seal material. Waterproof resin is used for this seal material. Waterproof resin get in a little to the insulating layer 202 and the end zone of heating resistor 203.

In such a constitution, it is preferable that a distance L between the scrape surface 205*a* of the electrode member 205 and the end surface 201*b* of the cylinder 201 is set to be small. This is because if the scrape surface 205*a* is projected greatly to the outside from the end surface 201*b* of the cylinder 201, the projected portion is liable to corrode, whereas the scrape surface 205*a* dents greatly, the length of the cylinder 201 cannot be utilized efficiently, so uniform heating becomes difficult. More specifically, in the case where the scrape surface 205*a* is in the outer or inner side of the end surface 201*b* of the cylinder 201, a ration L/D of an inner diameter D of the cylinder 201 and the length L may be set to 0.5.

Figure 21A:
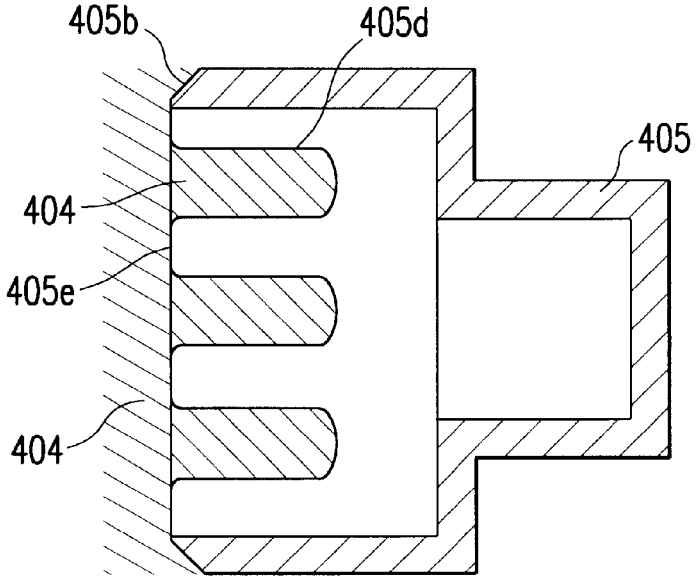
FIGS. 21(*a*) and 21(*b*) are a section view of the invention.
Figure 21B:
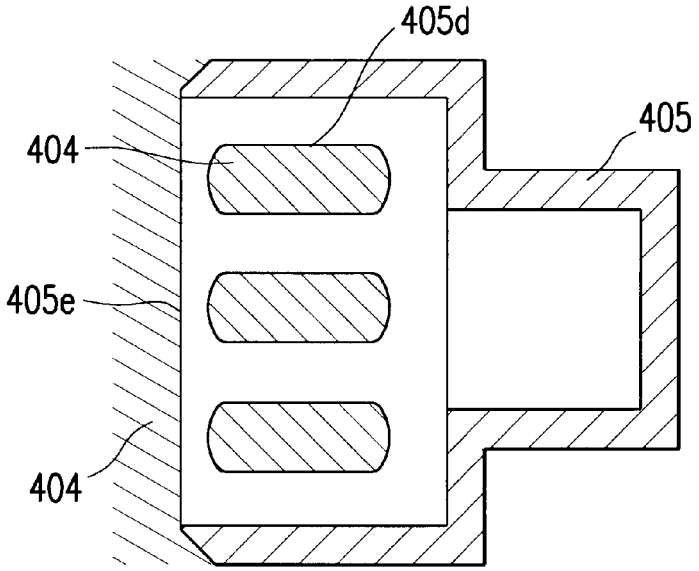

Further, as shown only electro member 405 section drawing in FIG. 21, the insert end of the cylinder 401 of electro member 405 can be formed the chamfering portion 405*b* of C-plane or R-plane.

As the insert end of the cylinder 401 of electro member 405 can be formed the chamfering portion 405*b,* when electro member 405 is inserted and is fixed into the cylinder 401, the heating surface 403 is not wounded, the heating resistor 403 is not broken down, the heating resistor 403 is not heated by power concentration, and the heating resistor 403 is not fused.

Therefore, the width D of the chamfering portion 405*b* of C-plane or R-plane formed on the insert end of the cylinder 401 of electro member 405 is suitable in the range of 0.2 mm to 2 mm. Because when said width D becomes lower than 0.2 mm, the heating resistor 403 is wounded, when said width D becomes exceeds 2 mm, the manufacturing becomes difficult according to the thickness of electro member 405 and working condition.

Further, as shown in FIG. 21, a hanging portion 405*d* formed unevenness or a through hole is provided on the paste surface between the heating 403 and the electro member 405, the hanging portion 405*d* can be filled up by a conductive adhesive 404, and the end zone 405*c* can be molded by a conductive adhesive 404.

As the hanging portion 405*d* is provided on the electro member 405, when electro member 405 is inserted and is fixed into the cylinder, the conductive adhesive 404 is filled up into the unevenness or through hole of the hanging portion 405*d* of the electro member 405, the distance of adhesive both end portion increase, the electro member and heating resistor firmly can adhere by increasing anchor effect.

Moreover, as conductive adhesive 404 is filled up and is molded into the hanging portion 405*d* and the end zone 405*e,* by utilize the shear strength of adhesive 404, the push strength inward the cylinder 401 of electro member 405 and the torque strength of electro member 405 alone rotation direction much increase. As a result, in use case of acting heat or strong force, the electro member 405 do not fall or do not get loose.

More, the hanging portion 405*d* do not limit the figure of the hanging portion 405*d,* if the hanging portion 405*d* utilize the shear strength of the conductive adhesive 404 and the shear strength, we can select various figures.

The metallic pipe composing the cylinder 201 is made of metal with heat conductivity of 0.03 cal/° C.·cm·sec, and more specifically aluminum or aluminum alloy, stainless, etc. is used, and its thickness of 0.5 to 1 mm. Moreover, the insulating layer 202 is composed of an organic resin with excellent heat resistance such as polyimide, phenol, silicon, borosiloxane, etc. and its thickness varies according to dielectric strength, but in the case of polyimide, the thickness of 10 to 200 $\mu$m is preferable. Moreover, the cleavage layer 206 is composed of a fluororesin, silicon or the like with excellent cleavage from toner.

Further, as the heating resistor 203, a mixture of an electrically conductive agent and a synthetic resin or glass composing matrix is used. Examples of the electrically conductive agent are metallic materials such as Ag, Ni, Au, Pd, Mo, Mn and W, and metallic compounds such as $Re_2O_3$, $Mn_2O_3$ and $LaMnO_3$, and at least one kind of them is used. Moreover, as the glass composing matrix, either of crystalline glass and non-crystalline glass may be used, but when crystalline glass is used, a change in the resistance value can be reduced also by thermal cycle. As its composition, the mixture containing 50 weight % or more PbO is suitable, and such a mixture whose softening point is not more than 500° C., namely, melting point is low is preferable.

The synthetic resin or glass composing the matrix is required for improving deposition strength, and they are included in the range of 10 to 90 weight % because if the content is less than 10 weight %, the deposition strength is lowered and resistance temperature coefficient is also lowered, whereas if the content exceeds 90 weight %, the resistance value becomes too large.

In addition, the thickness of the heating resistor 203 is 5 to 100 $\mu$m. This is because if the thickness is less than 5 $\mu$m, the resistance value becomes high and scattering is liable to occur, whereas the thickness exceeds 100 $\mu$m, the heating resistor 203 is liable to be peeled.

Further, examples of the electrode member 205 are materials whose difference in thermal expansion coefficient with the cylinder 201 is within $10\times10^{-6}$/° C., electric resistance value is not more than 10 $\mu$Q·cm, and melting point is not less than 800° C. More specifically, brass, copper, copper alloy, stainless, etc. or materials obtained such that the surfaces of these metal were subject to the metallizing treatment with nickel or the like are used.

The following describes the manufacturing method of the heating roller for fixing of the present invention shown in FIGS. 13 and 14.

First, after the cylinder 201 composed of a metallic pipe is processed in a prescribed shape, and the insulating layer 202 composed of an organic resin is applied to the inner circumferential surface by spin coating, spray coating, dipping, etc. so as to be stoved in air of 200 to 500° C. or in nitrogen atmosphere. A heating resistance component is mixed with an organic solvent, binder, dispersant or the like to be in paste form, and it is applied to the insulating layer 202 by screen printing, dipping, spray coating or the like and is calcined at 400 to 500° C. to form the heating resistor 203.

Thereafter, the electrode member 205 is joined to both the ends of the heating resistor 203 by using electrically conductive paste 204, and the outer circumferential surface of the cylinder 201 is coated with the cleavage layer 206.

The following describes another embodiment of the present invention.

Figure 15A:
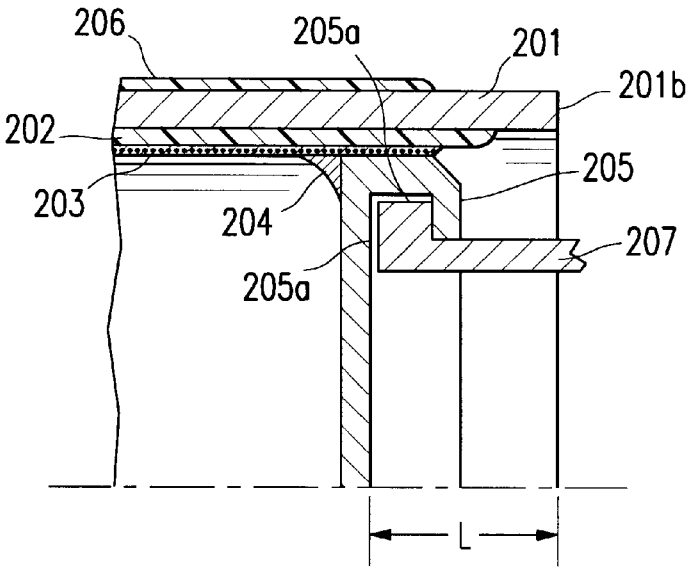
FIGS. 15(*a*) and (*b*) are enlarged sectional views illustrating another alternate embodiment of the invention.
Figure 15B:
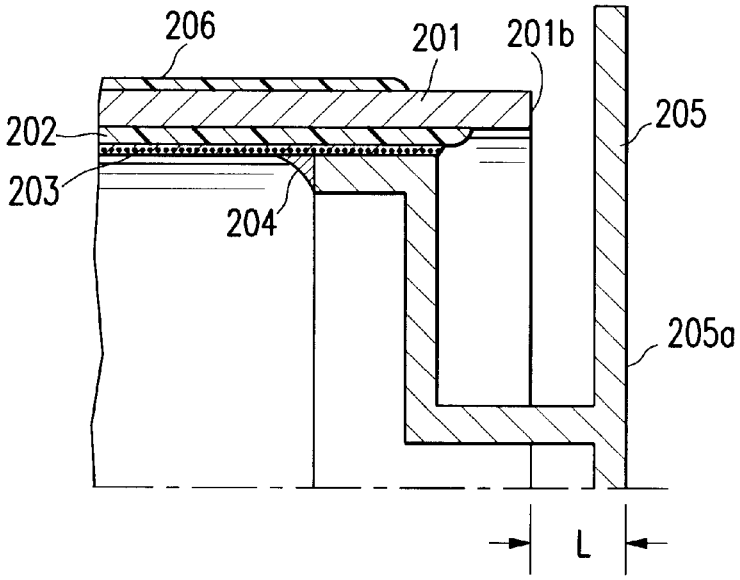

The constitution shown in FIG. 15(*a*) is such that the center portion of the electrode member 205 is depressed inward, and the load dispatching member 207 has a hook shape, and a circumferential portion of the depressed portion of the electrode member 205 is the scrape surface 205*a* with the load dispatching member 207. Moreover, the constitution shown in FIG. 15(*b*) is such that the central portion of the electrode member 205 is projected outward to have a ride plate shape, and the end surface of the plate portion is the scrape surface 205*a*.

Figure 16:
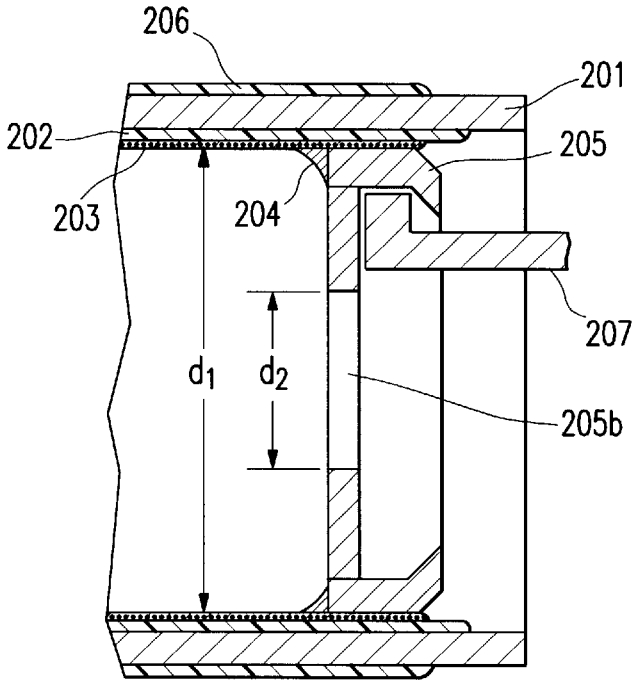
FIG. 16 is an enlarged sectional view illustrating another alternate embodiment of the invention.

In addition, the constitution shown in FIG. 16 is similar to that in FIG. 15(*a* ), but a through hole 205*b* is formed at the central portion of the electrode member 205. As mentioned above, it is not necessary that the electrode member 205 stops up the hollow of the cylinder 201 completely, and the through hole 205*b* may be provided partially. In such a case, area proportion of the portion stopped up with the electrode member 205 to an original open area in the hollow of the cylinder 201 is calculated, and the obtained value is a closing rate.

For example, as shown in FIG. 16, when an outer diameter of the electrode member 205 is $d_1$ and an inner diameter of the through hole 205*b* is $d_2$, the closing rate is represented as follows:

$$\text{Closing rate} = \left(\pi(d_1/2)^2 - \pi(d_2/2)^2\right)/\pi(d_1/2)^2 = (d_1^2 - d_2^2)/d_1^2$$

In the present invention, the closing rate is set to 5% or more, and preferably 36% or more.

In addition, in the embodiments shown in FIGS. 15 and 16, when a ratio L/D of a distance L between the scrape surface 205*a* of the electrode member 205 and the end surface 201*b* of the cylinder 201 and an inner diameter D of the cylinder 201 is set to not more than 3.0, corrosion of the electrode member 205 can be prevented, and uniform heating can be performed.

Since the aforementioned heating roller for fixing of the present invention is constituted such that the heating resistor 203 is energized, a temperature can be controlled more easily than the conventional heating roller using a halogen lamp.

Figure 17A:
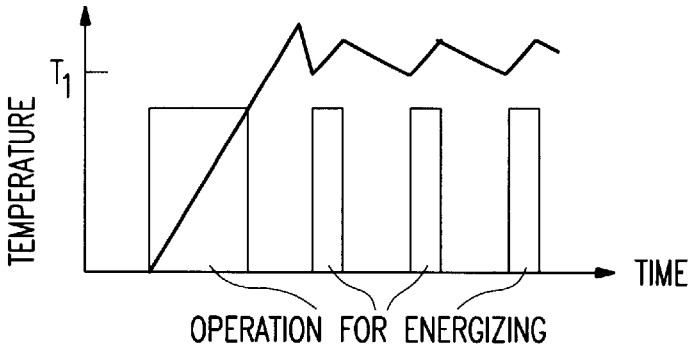
FIGS. 17(*a*) and 17(*b*) are graphs illustrating the temperature control condition of the heating roller for fixing: (a) is for a conventional embodiment; and (b) is for the present invention.
Figure 17B:
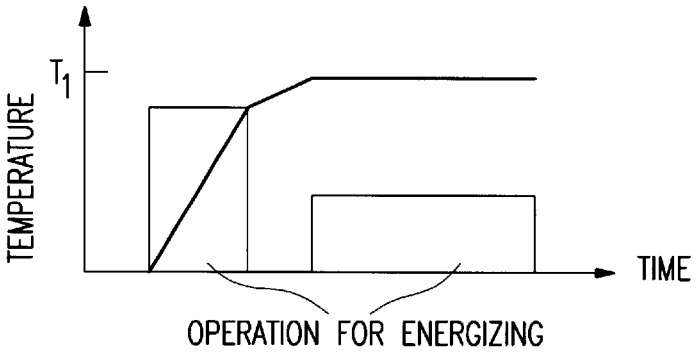
Figure 18A:
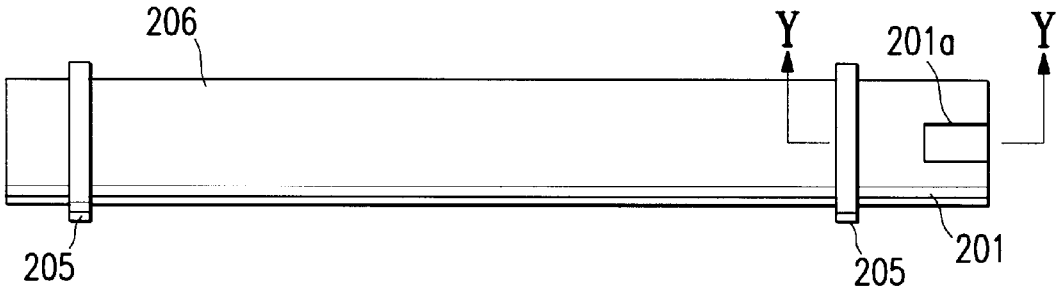
FIG. 18(*a*) is a side elevation view illustrating a conventional heating roller for fixing, and FIG. 18(*b*) is an enlarged sectional view taken on line Y—Y in (a).
Figure 18B:
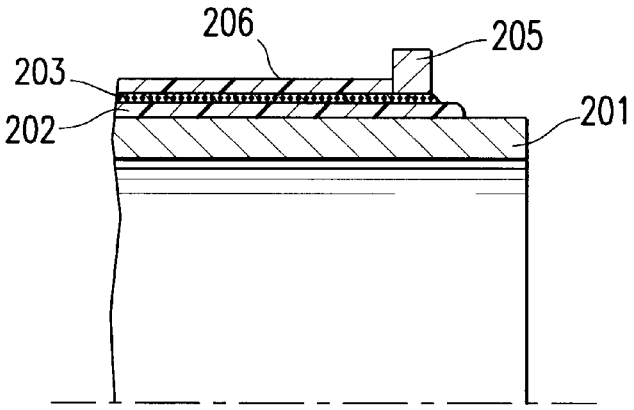

Namely, in the conventional heating roller for fixing using a halogen lamp, a temperature is controlled only by ON-OFF operation for energizing. For this reason, as shown in FIG. 17(*a*), electric power is supplied in the ON state so that a temperature is raised, and when reaching a target temperature $T_1$, the ON state is switched to the OFF state, and when the temperature is lowered, the OFF state is switched to the ON state again so that electric power is supplied. Therefore, it is difficult to maintain a constant temperature.

On the contrary, in the heating roller for fixing of the present invention, as shown in FIG. 17(*b*), a certain constant electric power is supplied so that a temperature is raised, and after reaching a target temperature $T_1$, low electric power is supplied continuously, so a constant temperature can be maintained securely.

The aforementioned embodiment describes only the heating roller for fixing, but the present invention can be used as another general cylindrical heater. For example, a cylindrical heater shown in FIGS. 13 through 16 can be used so as to heat liquid such as water and fuel, to heat various elements or used for heating or the like. In this case, the cylinder is not limited to cylindrical shape, so a square-shaped-cylinder can be also used.

The heating roller for fixing having a constitution shown in FIG. 26 was manufactured experimentally so that its outer diameter is 20 mm and its length is 280 mm. As the electrode member 205, as shown in Table 5, electrode members whose materials, thickness and inner diameter $d_2$ of the through hole 205*a* are various were prepared, and the closing rates of each electrode member was obtained according to the aforementioned formula. A voltage of 115 V was applied to the heating resistor 205 with these electrode members 205 being mounted to be heat the heating resistor 203, and a difference in temperature between the end portion and central portion on the outer circumferential surface of the cylinder 201 was measured.

The result is shown in Table 5. As is clear from Table 5, as for the electrode members 205 is which inner diameter $d_2$ of the through hole 205*b* is large, since the closing rate becomes small, and a heat on the end portion disperses easily, the difference in temperature is liable to become large. Moreover, in the electrode members 205 whose closing rate is less than 5% (No. 1, 5, 9, 13, 17 and 21), the difference in temperature exceeds 40° C., so they are unsuitable from a viewpoint of uniform heating. Therefore, it is found that the closing rate of 5% or more is suitable.

TABLE 5

| No. | Material | Thickness (mm) | Outer diameter $D_1$ (mm) | Outer diameter $D_2$ (mm) | Closing rate (%) | Difference in temperature (° C.) | Evaluation |
|---|---|---|---|---|---|---|---|
| 1 | Brass | 0.3 | 25 | 24.4 | 4.7 | 42 | x |
| 2 | | | | 20 | 36 | 29 | ○ |
| 3 | | | | 10 | 84 | 21 | ○ |
| 4 | | | | 0 | 100 | 18 | ○ |
| 5 | | 0.6 | | 24.4 | 4.7 | 49 | x |
| 6 | | | | 20 | 36 | 34 | ○ |
| 7 | | | | 10 | 84 | 28 | ○ |
| 8 | | | | 0 | 100 | 24 | ○ |
| 9 | | 1.0 | | 24.4 | 4.7 | 55 | x |
| 10 | | | | 20 | 36 | 39 | ○ |
| 11 | | | | 10 | 84 | 33 | ○ |
| 12 | | | | 0 | 100 | 28 | ○ |
| 13 | Stainless | 0.15 | 25 | 24.4 | 4.7 | 42 | x |
| 14 | (SUS304) | | | 20 | 36 | 29 | ○ |
| 15 | | | | 10 | 84 | 21 | ○ |
| 16 | | | | 0 | 100 | 18 | ○ |
| 17 | | 0.3 | | 24.4 | 4.7 | 49 | x |
| 18 | | | | 20 | 36 | 34 | ○ |
| 19 | | | | 10 | 84 | 28 | ○ |
| 20 | | | | 0 | 100 | 24 | ○ |
| 21 | | 0.5 | | 24.4 | 4.7 | 55 | x |
| 22 | | | | 20 | 36 | 39 | ○ |
| 23 | | | | 10 | 84 | 33 | ○ |
| 24 | | | | 0 | 100 | 28 | ○ |

Next, the electrode members 205 shown in FIG. 14 were used in the aforementioned heating rollers for fixing, but their mounting positions were varied, and the distances L between the end portions 201 of the cylinders 201 and the scrape surfaces 205*a* were varied. The difference in temperature between the end portions and central portions on the outer circumferential surfaces of the cylinders 201 was measured in the same manner as the above. Moreover, after the heating rollers for fixing were mounted to a fixing apparatus and a fixing test for 10000 sheets was put to the heating rollers for fixing, adhesion of toner to the electrode members 205 and a rate of change in contact resistance due to corrosion were measured.

The result is shown in Table 6. According to the result, when the scrape surface 205*a* is in the outer side and L/D exceeds 3.0 (No. 1), toner adhered to the electrode member 205, and a rate of change in contact resistance was 2%, namely, large. Therefore, this heating roller for fixing is not suitable. Moreover, when the scrape surface 205*a* is in the inner side and L/D exceeds 3.0 (No. 6), the difference in temperature exceeds 40° C., and this is also unsuitable.

On the contrary, when L/D is not more than 3.0 (No. 2 through 5), adhesion of toner and a change in contact resistance are little, and a difference in temperature is low. Therefore, it is found that the uniform heating can be performed.

TABLE 6

| No. | Position of scrape surface | L/D | Occurrence of adhesion of toner | Rate of change in contact resistance (%) | Difference in temperature (° C.) | Evaluation |
|---|---|---|---|---|---|---|
| 1 | Outer side | 4.0 | Occurred | 2 | 17 | x |
| 2 | Outer side | 3.0 | Occurred | 1.3 | 21 | ○ |
| 3 | | 0 | Occurred slightly | Not more than 1 | 26 | ○ |
| 4 | Inner side | 1.5 | Not occurred | Not more than 1 | 30 | ○ |
| 5 | Inner side | 3.0 | Not occurred | Not more than 1 | 34 | ○ |
| 6 | Inner side | 4.0 | Not occurred | Not more than 1 | 44 | ○ |

As mentioned above, according to the present invention, in a cylindrical heater which is constituted such that a heating resistor is provided to an inner surface of a cylinder and that an electrode member connected to the heating resistor is provided onto both ends of the inner side of the cylinder, when the electrode member stops up the cylinders, a generated heat is prevented from dispersing, heating can be performed uniformly and heat loss is lowered, so power can be saved.

In addition, since a load dispatching member for supplying power with it being scraped on the electrode member is provided, and a ratio L/D of a distance L between the scrape surface and the end surface of the cylinder and an inner diameter D of the cylinder is set to not more than 3.0, uniform heating can be performed, and corrosion or the like of the electrode member can be prevented.

Further, when the heating roller for fixing is constituted by using the cylindrical heater, uniform heating can be performed, so printing quality is improved, and power is saved. Therefore, heating roller for fixing with excellent durability can be obtained.

What is claimed is:

1. A heating roller for fixing which is constituted such that a heating resistor is provided onto a surface of a cylinder with an insulating layer lying therebetween and a cleavage layer is provided onto an outermost circumferential surface, characterized in that a maximum height (Rmax) of surface roughness on the surface of said cylinder on the side of said heating resistor is in the range of 0.8 to 50 $\mu$m.

2. The heating roller for fixing according to claim 1 characterized in that a protrusion whose height exceeds 50 $\mu$m does not exist on the surface of said cylinder on the side of the heating resistor, a number of protrusions with a height of 20 to 50 $\mu$m is less than 2 per 1 $cm^2$ and a number of protrusions with a height of 10 to 20 $\mu$m is less than 5 per 1 $cm^2$.

* * * * *